US010694589B2

(12) United States Patent
Blasco Rueda et al.

(10) Patent No.: US 10,694,589 B2
(45) Date of Patent: Jun. 23, 2020

(54) INDUCTION HOB DEVICE

(71) Applicant: BSH Hausgeräte GmbH, Munich (DE)

(72) Inventors: Nicolas Blasco Rueda, Saragossa (ES); Oscar Garcia-Izquierdo Gango, Saragossa (ES); Ignacio Garde Aranda, Saragossa (ES); Oscar Gracia Campos, Saragossa (ES); Pablo Jesus Hernandez Blasco, Cuarte de Huerva (ES); Daniel Palacios Tomas, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 726 days.

(21) Appl. No.: 15/030,382

(22) PCT Filed: Oct. 27, 2014

(86) PCT No.: PCT/IB2014/065630

§ 371 (c)(1),
(2) Date: Apr. 19, 2016

(87) PCT Pub. No.: WO2015/068077

PCT Pub. Date: May 14, 2015

(65) Prior Publication Data

US 2016/0262213 A1 Sep. 8, 2016

(30) Foreign Application Priority Data

Nov. 5, 2013 (ES) ..... 201331611

(51) Int. Cl.

| | |
|---|---|
| ***H05B 6/06*** | (2006.01) |
| ***F24C 7/08*** | (2006.01) |
| ***H05B 6/12*** | (2006.01) |

(52) U.S. Cl.
CPC ..... *H05B 6/062* (2013.01); *F24C 7/088* (2013.01); *H05B 2213/03* (2013.01); *H05B 2213/05* (2013.01)

(58) Field of Classification Search
CPC H05B 6/062; H05B 2213/03; H05B 2213/05; F24C 7/088

(Continued)

(56) References Cited

U.S. PATENT DOCUMENTS 3,953,783 A 4/1976 Peters, Jr.
5,886,429 A * 3/1999 Grady ..... G01R 31/001 307/106

(Continued)

FOREIGN PATENT DOCUMENTS

DE 102009020905 A1 * 12/2010 ..... H05B 6/062
DE 102009020905 A1 12/2010

(Continued)

OTHER PUBLICATIONS

International Search Report PCT/IB2014/065630 dated Feb. 13, 2015.
National Search Report ES P201331611 dated Jun. 30, 2014.

*Primary Examiner* — Lorne E Meade
*Assistant Examiner* — Kuangyue Chen
(74) *Attorney, Agent, or Firm* — Michael E. Tschupp; Andre Pallapies; Brandon G. Braun

(57) ABSTRACT

An induction hob device includes at least one induction heating element adapted to heat a cooking utensil, and at least one detection circuit which cooperates with the at least one induction heating element to detect a presence of the cooking utensil. The at least one detection circuit is hereby directly connected to the at least one induction heating element irrespective of an operating state.

22 Claims, 2 Drawing Sheets

(58) Field of Classification Search
USPC ..... 219/626
See application file for complete search history.

(56) References Cited

U.S. PATENT DOCUMENTS

| | | | | |
|---|---|---|---|---|
| 6,528,770 | B1 * | 3/2003 | Akel | H05B 6/04 219/624 |
| 8,796,602 | B2 | 8/2014 | Miyauchi | |
| 9,893,606 | B1 * | 2/2018 | Kubouchi | H02M 1/32 |
| 2007/0164017 | A1 * | 7/2007 | Gouardo | H05B 6/065 219/626 |
| 2010/0096385 | A1 * | 4/2010 | Gutierrez | H05B 6/062 219/626 |
| 2011/0233199 | A1 | 9/2011 | Garcia Jimenez et al. | |
| 2012/0318786 | A1 * | 12/2012 | Casanova Lacueva | H05B 6/062 219/626 |

FOREIGN PATENT DOCUMENTS

| | | | |
|---|---|---|---|
| EP | 1610590 | A1 | 12/2005 |
| EP | 2211591 | A1 | 7/2010 |
| EP | 2704523 | A2 | 3/2014 |

* cited by examiner

INDUCTION HOB DEVICE

CROSS-REFERENCES TO RELATED APPLICATIONS

This application is the U.S. National Stage of International Application No. PCT/IB2014/065630, filed Oct. 27, 2014, which designated the United States and has been published as International Publication No. WO 2015/068077 and which claims the priority of Spanish Patent Application, Serial No. P201331611, filed Nov. 5, 2013, pursuant to 35 U.S.C. 119(a)-(d).

BACKGROUND OF THE INVENTION

The invention is based on an induction hob device as claimed by the invention.

WO 2010/069788 A1 already discloses an induction hob device with an induction heating element, which is provided to heat positioned cooking utensils and with a detection circuit which is provided to co-operate with the induction heating element to detect positioned cooking utensils. The induction heating element is connected via a relay either to a heat frequency unit or to the detection circuit. The detection circuit is thus only connected to the induction heating element in a corresponding switching position of the relay.

BRIEF SUMMARY OF THE INVENTION

The object of the invention consists in particular in providing a generic device with an advantageous construction. The object is achieved according to the invention by the features of the independent claim, while advantageous embodiments and developments of the invention can be taken from the subclaims.

The invention is based on an induction hob device with at least one induction heating element, which is provided to heat cooking utensils, and with at least one detection circuit, which is provided to co-operate with the at least one induction heating element at least to detect positioned cooking utensils.

It is proposed that the at least one detection circuit is connected directly to the at least one induction heating element irrespective of an operating state. An 'induction hob device' is in particular to be understood to mean part, in particular a subassembly, of an induction hob. An "induction heating element" is to be understood in particular to mean a wound electrical conductor, through which high-frequency alternating current, in particular heating current, flows in at least one operating state. In particular, the induction heating element is provided to convert electrical energy into a magnetic alternating field, which is provided here, in a metallic, preferably at least partially ferromagnetic, cooking utensil, to generate eddy currents and/or non-magnetization effects, which are converted into heat. The induction heating element is preferably provided here to cause the cooking utensils to heat up. The induction hob device preferably comprises at least two, in particular at least three, advantageously at least four, particularly advantageously at least eight, preferably at least ten, particularly preferably a plurality of induction heating elements. A "detection circuit" is in particular to be understood to mean an electrical circuit, which is provided as a function of cooking utensils positioned in an installation position above the induction heating element in order to change at least one detection parameter. In particular, at least one detection current flows through the detection circuit at least in one operating state. In particular, the detection circuit is provided as a function of cooking utensils positioned in an installation position above the induction heating element in order to change at least one frequency of the detection current. Alternatively, the detection circuit could be provided as a function of cooking utensils positioned in an installation position above the induction heating element in order to change at least one phase angle of the detection current. Further detection parameters which appear meaningful to the person skilled in the art are likewise conceivable. The detection circuit is preferably provided to be supplied by at least one sensor current supply unit, which is embodied in particular separately from at least one power current supply unit for supplying the at least one induction heating element. The induction hob device preferably comprises at least two, in particular at least three, advantageously at least four, particularly advantageously at least eight, preferably at least ten, particularly preferably a plurality of detection circuits. A number of induction heating elements and a number of detection circuits is preferably at least substantially, in particular, precisely the same. Alternatively, it is conceivable for a detection circuit to be connected to at least two, in particular to at least three, advantageously to at least four, particularly advantageously to a plurality of induction heating elements. "Irrespective of an operating state" is in particular to be understood to mean irrespective of at least one position of at least one switching element and/or irrespective of a current flow through the induction heating element. The wording that the detection circuit is connected "directly" to the induction heating element irrespective of an operating state is to be understood in particular to mean that in each operating state the detection circuit and the induction heating element form a closed circuit particularly at least for alternating current. In particular, in each heating operating state, electric current, in particular alternating current, flows through the closed circuit. In particular, a detection current corresponding to a heating current flows through the detection circuit in each operating state. At least one, in particular at least for alternating current, electrically conducting connection exists between the detection circuit and the induction heating element irrespective of an operating state. In particular, a connection between the detection circuit and the induction heating element is free of switching elements, in particular of relays and/or transistors. "Provided" is understood in particular to mean especially programmed, configured and/or equipped. The fact that an object is provided for a specific function is in particular to be understood to mean that the object fulfills and/or executes this specific function in at least one application and/or operating state.

The inventive embodiment allows an induction hob device to be provided with an advantageous construction. In particular, low production costs can be achieved. In particular, it is possible to dispense with switching elements for establishing a connection between the detection circuit and the induction heating element. In particular, problems due to a low current through contacts of a switching element, in particular a relay, can be avoided. Moreover, a detection can be advantageously performed irrespective of a switching position of a switching element, in particular of a relay.

Alternatively or in addition to the inventive embodiment, an induction hob device is proposed with at least one induction heating element, which is part of at least one power oscillating circuit and is provided at least to heat up cooking utensils, and with at least one detection circuit, which is provided at least to detect cooking utensils and which comprises the at least one induction heating element in at least one operating state, wherein the at least one detection circuit has at least one protection unit, which is connected to the at least one induction heating element and diverges from the at least one power oscillating circuit. The protection unit is provided here in particular at least to protect the at least one detection circuit from external voltages irrespective of an operating state, in particular at least in one heating operating state. In particular, the at least one protection unit is provided to at least substantially prevent entry of in particular high-frequency heating current into the detection circuit. A value of a frequency of a detection current preferably differs from a value of a frequency of a heating current by a factor of at least 10, in particular of at least 100, advantageously of at least 500, particularly advantageously of at least 1000. "External voltages" are in particular to be understood to mean voltages which in one operating state advantageously drop across at least one heat frequency unit and/or across the at least one induction heating element. Alternatively or in addition "external voltages" are to be understood to mean in particular voltages which are provided in particular to be used in an operating state to operate the at least one induction heating element. The wording that the protection unit is provided "to at least substantially prevent" entry of in particular high-frequency heating current into the detection circuit is in particular to be understood to mean that the protection unit is provided to prevent a portion of at most 50%, in particular of at most 30%, advantageously of at most 15%, particularly advantageously of at most 10%, preferably of at most 5% and particularly preferably of at most 2% of heating current hitting one side of the protection unit from passing, in particular reaching a second side of the protection unit which faces away from the first side. As a result, an induction hob device can in particular be provided with an advantageous construction, wherein advantageously a precise detection of cooking utensils can be achieved.

It is further proposed that the induction hob device comprises at least one heat frequency unit for supplying the at least one induction heating element, wherein the at least one detection circuit is diverged from a connection between the at least one heat frequency unit and the at least one induction heating element. A "heat frequency unit" is in particular to be understood to mean an electrical unit, which generates an oscillating electrical signal, preferably with a frequency of at least 1 kHz, in particular of at least 10 kHz, advantageously of at least 20 kHz and in particular of at most 100 kHz for at least one induction heating element. In particular, the heat frequency unit is provided to supply a maximum electrical output required by the induction heating element of at least 100 W, in particular at least 500 W, advantageously at least 1000 W and preferably at least 1500 W. The heat frequency unit advantageously comprises at least one inverter, which preferably has at least two bidirectional unipolar switches which are preferably connected in series, which are formed in particular by a transistor and a diode connected in parallel thereto, and particularly advantageously at least one damping capacitor connected in parallel to the bidirectional unipolar switches, which is formed in particular by at least one capacitor. A voltage tap of the heat frequency unit is arranged in particular on a shared contact point between two bidirectional unipolar switches. In particular, the at least one heat frequency unit and the at least one induction heating element form the at least one power oscillating circuit at least in one operating state. A "connection" between the heat frequency unit and the induction heating element is to be understood in particular to mean a bridging of at least one gap between the heat frequency unit and the induction heating element, which is electrically conductive in at least one operating state. The connection between the heat frequency unit and the induction heating element could take place directly and/or via at least one switching element for instance. The wording that the detection circuit is "diverged" from a connection between the heat frequency unit and the induction heating element is in particular to be understood to mean that at least one and preferably precisely one electrically conductive contact point exists, by means of which the detection circuit is connected to the connection between the heat frequency unit and the induction heating element. As a result, a precise detection of cooking utensils positioned on the induction heating element can in particular be achieved.

Moreover, it is proposed that the induction hob device comprises at least one protection unit, which is provided to protect at least the at least one detection circuit from external voltages which occur in particular during operation of the at least one induction heating element, irrespective of an operating state, in particular at least in one heating operating state. As a result, an entry of high-frequency alternating current into the detection switching circuit can be avoided. In particular, components which are configured for low voltage can be used instead of components which are configured for high performance, as a result of which a cost-effective embodiment can in particular be achieved.

Moreover, it is proposed that irrespective of an operating state the at least one protection unit is connected between an input of the at least one detection circuit and a divergence from the connection between the at least one heat frequency unit and the at least one induction heating element. In particular, the protection unit is connected to a side of the divergence from the connection between the heat frequency unit and the induction heating unit, said side facing the detection circuit. In particular, the protection unit is arranged outside of the power oscillating circuit irrespective of an operating state. As a result, a durable embodiment can be achieved in particular.

Furthermore, it is proposed for the at least one protection unit to have at least one capacitor. In particular, the capacitor differs from a capacitor of the power oscillating circuit, particularly from a damping capacitor and/or a resonance capacitor. As a result, a cost-effective embodiment can be achieved in particular.

Moreover, it is proposed that the at least one detection circuit and the at least one induction heating element form an oscillating circuit at least in one operating state, in particular outside of a heating operating state. An "oscillating circuit" is to be understood in particular to mean a resonance-capable electric circuit, which comprises at least the induction heating element and at least one capacitance, which is part of the detection circuit in particular. In particular, the detection circuit and the induction heating element are provided to execute electrical oscillations at least in one operating state. As a result, positioned cooking utensils can be precisely detected.

Furthermore, it is proposed that the induction hob device comprises a control unit, which is provided to determine at least one cooking utensil parameter as a function of a natural frequency change of the at least one detection circuit. A "control unit" is in particular understood to mean an electronic unit, which is preferably integrated at least partially in a control and/or regulating unit of an induction hob and which is preferably provided to control and/or regulate at least the heating unit. The control unit preferably comprises a computing unit and in particular in addition to the computing unit a storage unit with a control and/or regulating program stored therein, which is provided to be executed by the computing unit. In particular, the control unit has at least one amplifier at least for amplifying the detection current. In particular, the control unit has at least one analog-digital converter at least for converting the detection current. In particular, the cooking utensil parameter is configured as the presence and/or absence of positioned cooking utensils. In particular, the cooking utensil parameter is configured as a size and/or shape and/or material of the positioned cooking utensil. Alternatively, further embodiments of the cooking utensil parameter which appear meaningful to a person skilled in the art are conceivable. As a result, high user-friendliness can be achieved in particular for an operator. In particular, the cooking utensil parameter can be determined exactly.

Furthermore, it is proposed that the at least one detection circuit is provided to detect cooking utensils, in particular exclusively, outside of a heating operating state. In particular, the heat frequency unit, in particular the damping capacitor of the heat frequency unit, is provided to prevent, in particular block, a detection of positioned cooking utensils in the heating operating state. In particular, the damping capacitor is provided to short-circuit the detection circuit in the heating operating state. As a result, a durable and/or cost-effective embodiment can be achieved in particular.

BRIEF DESCRIPTION OF THE DRAWINGS

Further advantages result from the description of the drawings below. Exemplary embodiments of the invention are shown in the drawing. The drawing, the description and the claims contain numerous features in combination. The person skilled in the art will also expediently consider the features individually and combine them to form further meaningful combinations, in which:

DETAILED DESCRIPTION OF EXEMPLARY EMBODIMENTS OF THE PRESENT INVENTION

Figure 1:
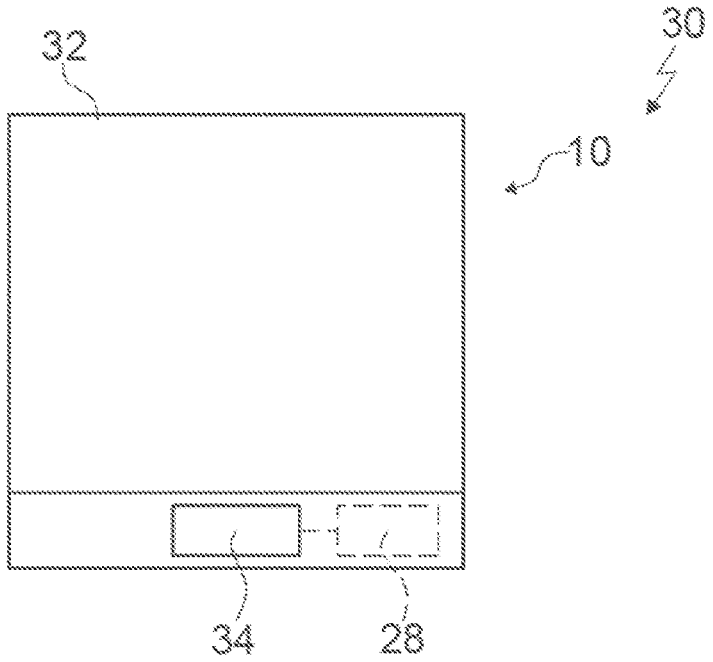
FIG. 1 shows an induction hob with an inventive induction hob device in a schematic top view.

FIG. 1 shows an induction hob 30 with an inventive induction hob device 10. The induction hob 30 has a base body 32 for positioning cooking utensils. The base body 32 is embodied as a hotplate. The base body 32 forms a cooktop. The induction hob 30 comprises a control unit 34 for inputting and/or selecting operating parameters, for instance a heating power and/or a heating power density and/or a heating zone. The control unit 34 is provided to output a value of an operating parameter to an operator. The induction hob device 10 comprises a control unit 28, which is provided to perform actions as a function of the operating parameters entered by means of the control unit 34 and/or to change settings.

Figure 2:
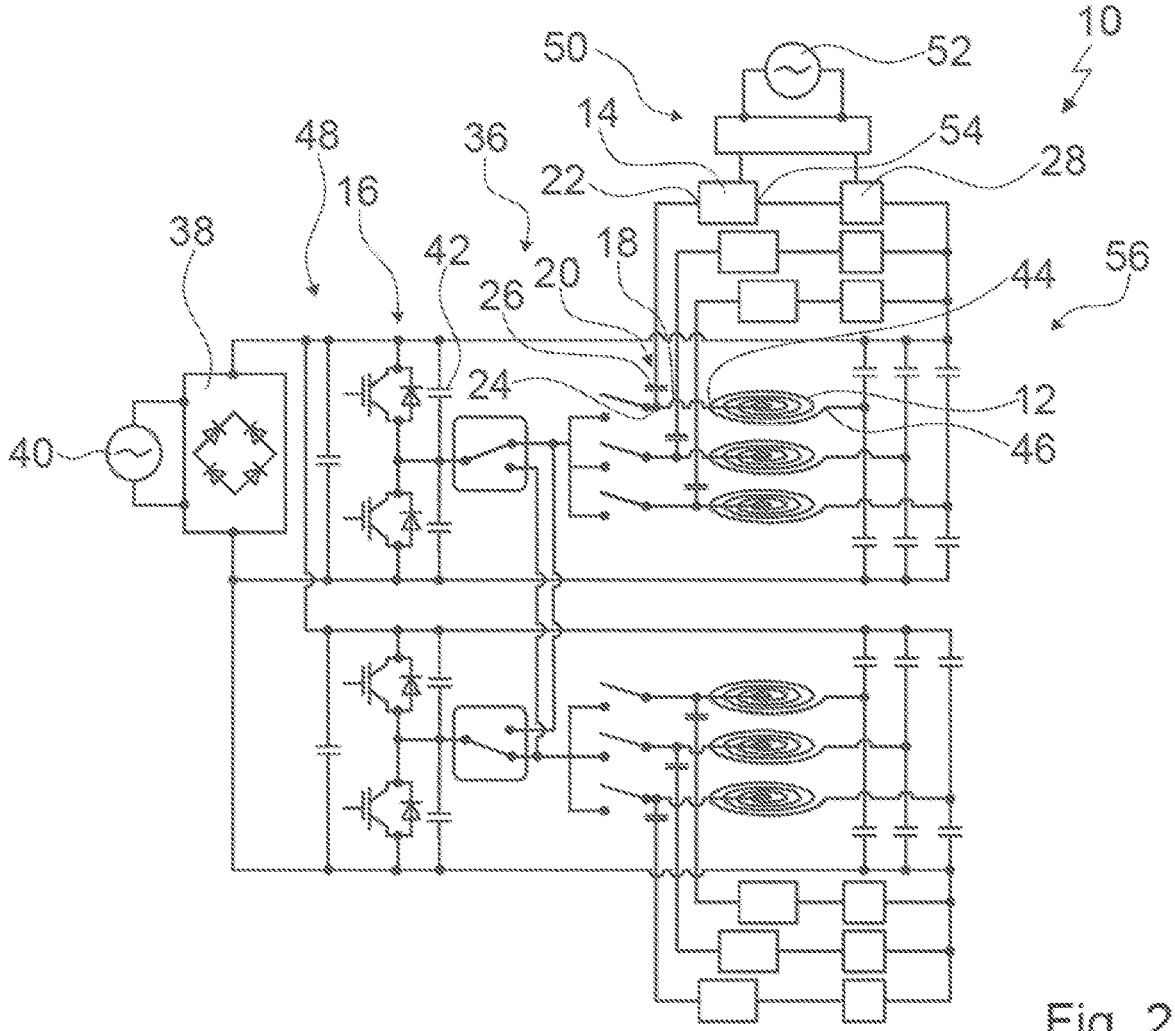
FIG. 2 shows an application example of the induction hob device from FIG. 1 in a schematic representation.

The induction hob device 10 comprises a number of induction heating elements 12, which are provided to heat up the positioned cooking utensils (cf. FIG. 2). For the sake of clarity, only one of a number of existing components and/or objects is provided with a reference character in FIG. 2. The induction heating elements 12 form a variable cooktop area. The induction heating elements 12 form a hob matrix. In an alternative embodiment, it is conceivable for the induction heating elements to be embodied as conventional induction heating elements to form a conventional cooktop. Each induction heating element here may embody a separate heating zone to heat the positioned cooking utensils.

The induction hob device 10 comprises a number of heat frequency units 16 to supply the induction heating elements 12. The heat frequency units 16 are part of a power current supply unit 48, which is provided to supply the induction heating elements 12. Each heat frequency unit 16 comprises an inverter. Each heat frequency unit 16 comprises two bidirectional unipolar switches which are connected in series. Each heat frequency unit 16 comprises two damping capacitors 42 which are connected in series. A damping capacitor 42 is connected in parallel to one of the unipolar switches in each case. In one operating state, the heat frequency units 16 generate high-frequency alternating current to supply the induction heating elements 12. The high-frequency alternating current is embodied as a heating current. The heating current has a frequency of a number of kilohertz. For instance, the heating current may have a frequency of between 25 kHz and 75 kHz in one heating operating state. Alternatively, further frequencies which appear meaningful to a person skilled in the art are conceivable.

The heat frequency units 16 are connected to the induction heating elements 12 by means in each case of an electrically conducting connection 18. The induction heating elements 12 are connected by way of a resonance unit 56 to ground with the connection points 46 which face away from the heat frequency units 16. The heat frequency units 16 form a power oscillating circuit in a heating operating state with the induction heating elements 12 and a part of the resonance unit 56. The induction hob device 10 comprises the resonance unit 56. The resonance unit 56 comprises a resonance capacitor for each induction heating element 12. Each resonance capacitance has two capacitors.

Figure 4:
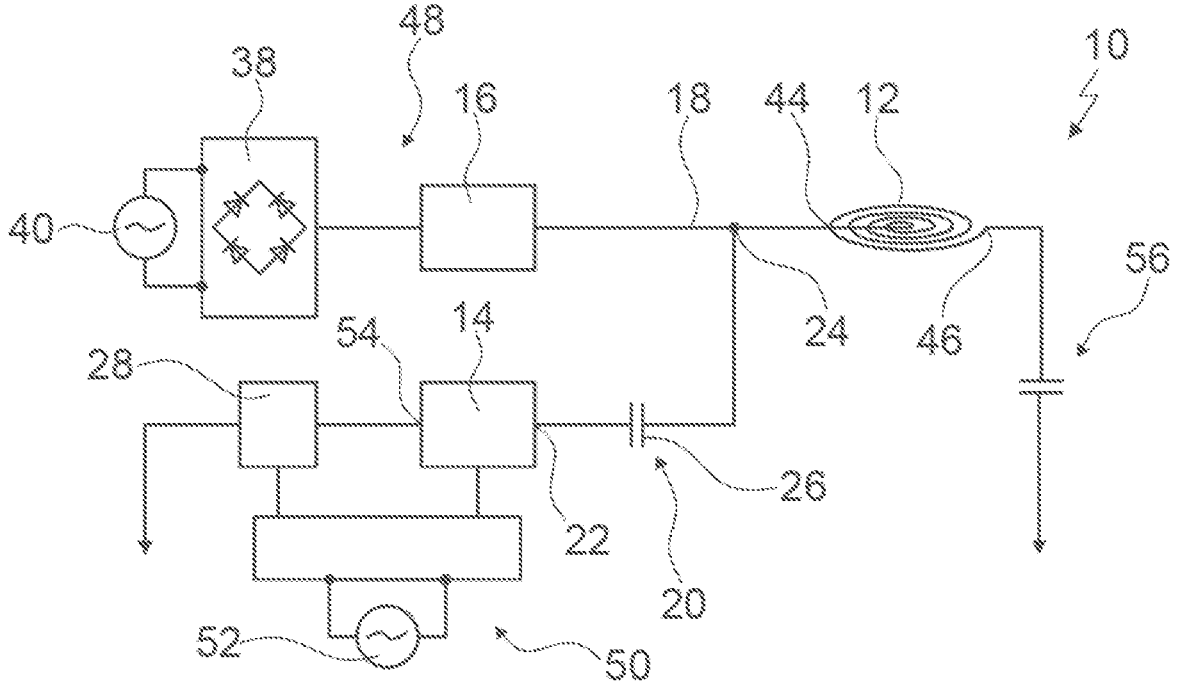
FIG. 4 shows a cutout of an alternative embodiment of the inventive induction hob device from FIG. 1 in a very simplified, schematic representation.

The induction hob device 10 comprises a circuit unit 36, which is provided to establish or interrupt the connection 18 between the heat frequency units 16 and the induction heating elements 12. The circuit unit 36 comprises a number of switching elements, wherein each switching element is arranged in one of the connections 18 between one of the heat frequency units 16 and one of the induction heat elements 12. The circuit unit 36 can be controlled by the control unit 28. Alternatively, one embodiment is conceivable by avoiding a circuit unit, wherein the heat frequency units and the induction heating elements are directly connected to one another (cf. FIG. 4). The connection between the heat frequency units and the induction heating elements is uninterrupted here, in particular is electrically conducting irrespective of an operating state.

The induction hob device 10 comprises a number of rectifiers 38, which are connected to a phase 40 of a supply network (cf. FIG. 2). The rectifiers 38 rectify an alternating current coupled by way of the phase 40. Each rectifier 38 is connected to two heat frequency units 16. Each two heat frequency units 16 are connected to the phase 40 of the supply network by way of a rectifier 38.

The induction hob device 10 comprises a number of detection circuits 14. Each detection circuit 14 is provided to cooperate with an induction heating element 12 in each case to detect the positioned cooking utensils. Each detection circuit 14 is directly connected to one of the induction heating elements 12 irrespective of an operating state (cf.

Figure 3:
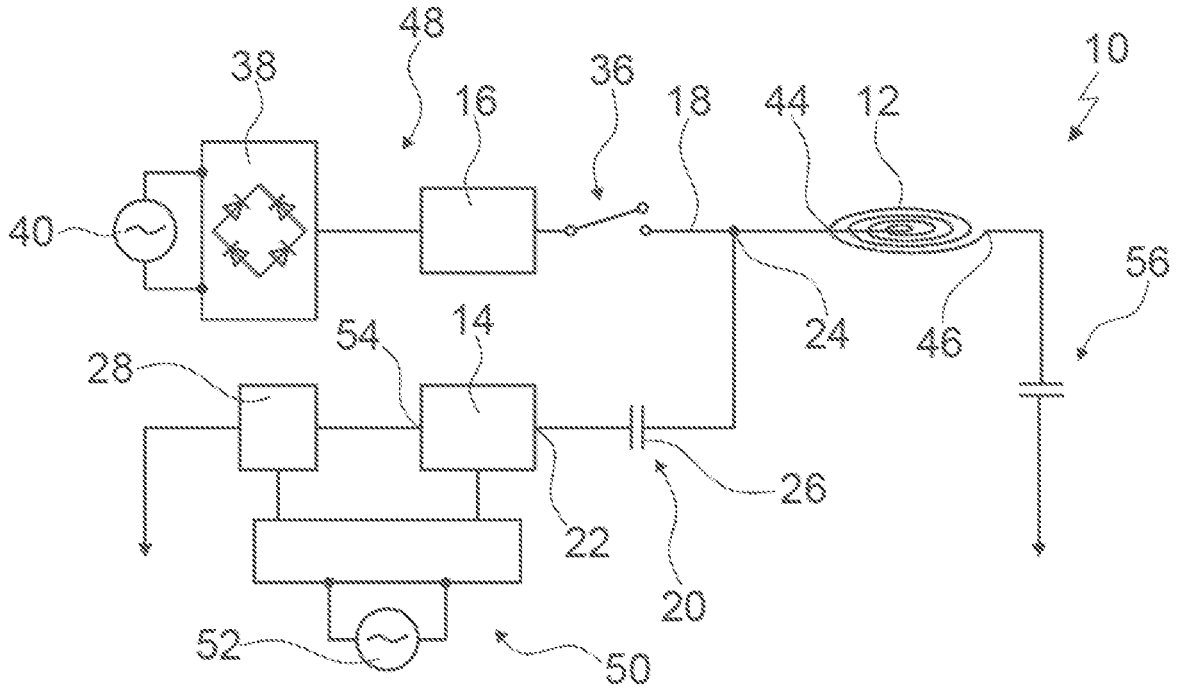
FIG. 3 shows a cutout of the induction hob device from FIG. 1 in a very simplified, schematic representation

FIG. 3). The detection circuits 14 are directly connected to the induction heating elements 12 irrespective of a switching position of the circuit unit 36. In the present exemplary embodiment, each detection circuit 14 is connected to a connection point 44 of the induction heating element 12 which faces the heat frequency unit 16. The detection circuits 14 are diverged from the connections 18 between the heat frequency units 16 and the induction heating elements 12. The divergences 24 from the connections 18 between the heat frequency units 16 and the induction heating elements 12 are arranged between the connection points 44 facing the heat frequency units 16 and the circuit unit 36.

The induction hob device 10 comprises a number of protection units 20, which are provided to protect the detection circuits 14 from external voltages irrespective of an operating state. The protection units 20 are connected to sides of the divergences 24 facing the detection circuits 14 irrespective of an operating state. The protection units 20 are connected, irrespective of an operating state, between an input 22 of the detection circuits 14 and the divergences 24 from the connections 18 between the heat frequency units 16 and the induction heating elements 12. The protection units 20 each have a capacitor 26. In the present exemplary embodiment, the capacitors 26 have capacitances of substantially 100 pF. In one heating operating state for the heating current, the protection units 20 have a resistance with a value between 200 kf2 and 600 kr2. Alternatively, capacitors with a capacitance in a range of 50 pF to 150 pF are preferably conceivable. In addition or alternatively, the protection unit may have any series and/or parallel connection of capacitors. Moreover, further protection units which appear meaningful to a person skilled in the art are conceivable as an alternative to a capacitor.

The induction hob device 10 comprises a sensor current supply unit 50, which is provided to supply the detection circuits 14 with detection current. The sensor current supply unit 50 is provided to supply the control unit 28. The sensor current supply unit 50 and the power current supply unit 48 are embodied separately. The sensor current supply unit 50 is connected to one phase 52 of the supply network. The phase 52 to which the sensor current supply unit 50 is connected differs from the phase 40 to which the power current supply unit 48 is connected. Alternatively, it is conceivable for the power current supply unit and the sensor current supply unit to be connected to the same phase. In both cases the induction heating elements 12 and the detection circuits 14 are supplied independently of one another.

In a method for operating the induction hob device 10, positioned cooking utensils are detected in cooperation with the detection circuits 14 and the induction heating elements 12. In one operating state, the detection circuits 14 apply the induction heating elements 12 with a high-frequency alternating current, which is embodied as a detection current. The detection current has a frequency of a few MHz. For instance, the detection current may have a frequency of between 1.5 MHz and 2.2. MHz in one operating state. Alternatively, further frequencies which appear meaningful to a person skilled in the art are conceivable. The protection units 20 have a resistance with a value between 0.7 kf2 and 1 kr2 for the detection current. In the operating state, one of the detection circuits 14 and one of the induction heating elements 12 each form an oscillating circuit.

In the case of an induction heating element 12, which is free of positioned cooking utensils, one frequency of the detection current amounts to substantially 1.5 MHz. With cooking utensils positioned on the induction heating element 12, the frequency of the detection current increases as a function of the size, shape and material of the positioned cooking utensil. In each case, an output 54 of one of the detection circuits 14 is connected to the control unit 28. The output 54 of the detection circuit 14 is connected to the ground by way of the control unit 28. The control unit 28 determines a cooking utensil parameter as a function of a natural frequency change of the detection circuit 14. The control unit 28 determines the size, shape and material of the positioned cooking utensil on the basis of the extent of the natural frequency change in the detection current.

In an operating state, in which the detection circuits 14 detect the positioned cooking utensils, the connections 18 between the heat frequency units 16 and the induction heating elements 12 are interrupted by the circuit unit 36. An operating state, in which the detection circuits 14 detect positioned cooking utensils, is embodied separately from a heating operating state, in which the induction heating elements 12 heat the positioned cooking utensils.

In a heating operating state, at least one of the connections 18 is established between the heat frequency units 16 and the induction heating elements 12. In one heating operating state, the detection circuits 14 diverged from the connections 18 between the heat frequency units 16 and the induction heating elements 12 are short-circuited by the damping capacitors 42 of the heat frequency unit 16. The damping capacitors 42 have a low impedance with a frequency of the detection current, as a result of which the detection circuits 14 connected directly to the induction heating elements 12 are short-circuited. In a heating operating state, high frequency alternating currents flow through the oscillating circuits formed by the induction heat elements 12 and the detection circuits 14, said high-frequency alternating currents substantially having the same frequency as the heating currents. The detection circuits 14 detect cooking utensils positioned outside of a heat operating state. Detection currents flow through the oscillating circuits formed by the induction heating elements 12 and the detection circuits 14 outside of a heating operating state.

In an alternative embodiment, it is conceivable that a number of detection circuits is lower than a number of induction heating elements. Here the detection circuits could be connected to a number of induction heating elements by multiplexing, wherein the protection unit could be arranged between the multiplexer and the induction heat elements. It is likewise conceivable for the protection unit to be arranged between the multiplexer and the input of the detection circuit.

Alternatively to connecting the outputs of the detection circuits to ground, it is conceivable for the outputs of the detection circuits to be connected to the connection points of the induction heat elements which face away from the heat frequency units. A further protection unit, in particular in addition to the protection unit which diverges from the connection between the heat frequency unit and the induction heating element, could be provided here between the outputs of the detection circuits and the connection points of the induction heating elements which face away therefrom.

It is conceivable for instance for the control unit to be provided to enable a heating operating state, in particular an operation of the induction heating element, in particular exclusively when the cooking utensil is positioned thereupon and in particular to prevent the same when there is no cooking utensil positioned thereupon.

The invention claimed is:

1. An induction hob device, comprising:

at least one induction heating element adapted to heat a cooking utensil;

at least one detection circuit cooperating with the at least one induction heating element to detect a presence of the cooking utensil, said at least one detection circuit being directly connected to the at least one induction heating element irrespective of an operating state, said at least one detection circuit being configured to change at least one detection parameter of the at least one detection circuit;

at least one heat frequency unit which comprises a plurality of damping capacitors connected in series and is configured to supply the at least one induction heating element;

a control unit configured to determine at least one cooking utensil parameter as a function of a natural frequency change of the at least one detection circuit;

at least one power current supply unit which is configured to supply the at least one induction heating element; and at least one sensor current supply unit which is configured supply the at least one detection circuit and is embodied separately from the at least one power currently supply unit.

2. The induction hob device of claim 1, further comprising a circuit unit which is arranged between the at least one heat frequency unit and the at least one induction heating element, wherein said at least one detection circuit diverges from a connection between the at least one heat frequency unit and the at least one induction heating element.

3. The induction hob device of claim 1, further comprising at least one protection unit adapted to protect the at least one detection circuit from external voltages irrespective of an operating state.

4. The induction hob device of claim 2, further comprising at least one protection unit adapted to protect the at least one detection circuit from external voltages irrespective of an operating state, said at least one protection unit being connected, irrespective of an operating state, between an input of the at least one detection circuit and a divergence from the connection between the at least one heat frequency unit and the at least one induction heating element.

5. The induction hob device of claim 3, wherein the at least one protection unit has at least one capacitor.

6. The induction hob device of claim 1, wherein the at least one detection circuit and the at least one induction heating element form an oscillating circuit at least in one operating state.

7. The induction hob device of claim 1, wherein the at least one detection circuit is configured to detect a presence of the cooking utensil outside of a heating operating state.

8. An induction hob, comprising at least one induction hob device, said at least one induction hob device comprising at least one induction heating element adapted to heat a cooking utensil, at least one detection circuit cooperating with the at least one induction heating element to detect a presence of the cooking utensil, said at least one detection circuit being directly connected to the at least one induction heating element irrespective of an operating state, at least one sensor current supply unit configured to supply the at least one detection circuit with a detection current, at least one heat frequency unit which comprises a plurality of damping capacitors connected in series and is configured to supply the at least one induction heating element, a control unit configured to determine at least one cooking utensil parameter as a function of a natural frequency change of the at least one detection circuit, at least one power current supply unit which is configured to supply the at least one induction heating element, and at least one sensor current supply unit which is configured supply the at least one detection circuit and is embodied separately from the at least one power currently supply unit.

9. The induction hob of claim 8, further comprising a circuit unit which is arranged between the at least one heat frequency unit and the at least one induction heating element, wherein said at least one detection circuit diverges from a connection between the at least one heat frequency unit and the at least one induction heating element.

10. The induction hob of claim 8, wherein the at least one induction hob device includes at least one protection unit adapted to protect the at least one detection circuit from external voltages irrespective of an operating state.

11. The induction hob device of claim 9, wherein the at least one induction hob device includes at least one protection unit adapted to protect the at least one detection circuit from external voltages irrespective of an operating state, said at least one protection unit being connected, irrespective of an operating state, between an input of the at least one detection circuit and a divergence from the connection between the at least one heat frequency unit and the at least one induction heating element.

12. The induction hob of claim 10, wherein the at least one protection unit has at least one capacitor.

13. The induction hob of claim 8, wherein the at least one detection circuit and the at least one induction heating element form an oscillating circuit at least in one operating state.

14. The induction hob of claim 8, wherein the at least one detection circuit is configured to detect a presence of the cooking utensil outside of a heating operating state.

15. A method for operating an induction hob device, comprising:

directly connecting at least one detection circuit of the induction hob device to at least one induction heating element of the induction hob device irrespective of an operating state;

supplying the at least one induction heating element through at least one power current supply unit;

supplying the detection circuit through at least one sensor current supply unit which is embodied separately from the at least one power current supply unit supplying the at least one induction heating element, the at least one sensor current supply unit supplies the at least one detection circuit with a detection current; and detecting the presence of a positioned cooking utensil as a result of a cooperation of the at least one detection circuit with the at least one induction heating element.

16. The method of claim 15, further comprising supplying the at least one induction heating element via at least one heat frequency unit which is part of the at least one power current supply unit, and diverging the at least one detection circuit from a connection between the at least one heat frequency unit and the at least one induction heating element.

17. The method of claim 15, further comprising protecting the at least one detection circuit from external voltages irrespective of an operating state.

18. The method of claim 15, further comprising connecting at least one protection unit adapted to protect the at least one detection circuit from external voltages irrespective of an operating state, between an input of the at least one detection circuit and a divergence from a connection between an at least one heat frequency unit and the at least one induction heating element irrespective of an operating state.

19. The method of claim 18, further comprising providing the at least one protection unit with at least one capacitor.

20. The method of claim 15, further comprising forming an oscillating circuit at least in one operating state jointly by the at least one detection circuit and the at least one induction heating element.

21. The method of claim 15, further comprising determining at least one cooking utensil parameter as a function of a natural frequency change of the at least one detection circuit.

22. The method of claim 15, further comprising detecting a presence of the cooking utensil outside of a heating operating state via the at least one detection circuit.

* * * * *